US005445055A

United States Patent [19]

Koponen et al.

[11] Patent Number: 5,445,055

[45] Date of Patent: Aug. 29, 1995

[54] METHOD FOR CUTTING OF THE LEADER OF THE WEB IN A PAPER OR BOARD MACHINE IN THE DRYING SECTION OF THE MACHINE

[75] Inventors: Ismo Koponen; Jari Vainio; Umari Rintasalo, all of Rauma, Finland

[73] Assignee: Valmet Paper Machinery, Inc., Helsinki, Finland

[21] Appl. No.: 81,358

[22] PCT Filed: Nov. 18, 1992

[86] PCT No.: PCT/FI92/00311

§ 371 Date: Jun. 22, 1993

§ 102(e) Date: Jun. 22, 1993

[87] PCT Pub. No.: WO93/10307

PCT Pub. Date: May 27, 1993

[30] Foreign Application Priority Data

Nov. 19, 1991 [FI] Finland ..... 915450

[51] Int. Cl.[6] ..... B26F 3/00; D21F 5/04

[52] U.S. Cl. ..... 83/53; 83/177; 162/194; 162/286; 34/117

[58] Field of Search ..... 83/53, 177; 162/286, 162/193, 194, 195; 34/117, 120

[56] References Cited

U.S. PATENT DOCUMENTS

| | | | |
|---|---|---|---|
| 3,625,813 | 12/1971 | Eckelman | 162/286 |
| 5,185,063 | 2/1993 | Aula et al. | 162/194 X |
| 5,248,390 | 9/1993 | Fissmann et al. | 162/194 X |

FOREIGN PATENT DOCUMENTS

| | | |
|---|---|---|
| 0444316 | 9/1991 | European Pat. Off. . |
| 3924897 | 2/1991 | Germany . |

*Primary Examiner*—Richard K. Seidel
*Assistant Examiner*—Raymond D. Woods
*Attorney, Agent, or Firm*—Steinberg, Raskin & Davidson

[57] ABSTRACT

A method for cutting of the leader of the web in a paper or board machine in the drying section of the machine by a jet of pressurized water. According to the method, the web is placed against the drying wire when it is being cut, and the jet is directed at the web from the free side of the web. The water-jet pressure used is about 40 bar to about 400 bar bar, preferably about 100 bar, which is produced by an ordinary pressure washer.

6 Claims, 3 Drawing Sheets

METHOD FOR CUTTING OF THE LEADER OF THE WEB IN A PAPER OR BOARD MACHINE IN THE DRYING SECTION OF THE MACHINE

BACKGROUND OF THE INVENTION

The invention concerns the cutting of the leader of the web in a paper or board machine in the drying section of said machine and in cylinder drying sections of on-machine coating machines. At present, for said purpose, a revolving toothed circular blade (circular saw) is used, in which case the paper web must be separated from the drying wire at the cutting point in order that the blade should not cut the drying wire as well.

A second mode is cutting of the web that has been separated from the drying wire by means of a high-pressure water jet (P>400 bar). The required pressure is high, because, with lower pressures, the web that is not supported against the drying wire at the cutting point is torn irregularly, which results in web breaks.

In many paper and board machines, the cutting of the leader of the web is carried out at the so-called wet end of the machine on the Fourdrinier wire or below the so-called pick-up felt in the press section. In said cutting processes, the dry solids content of the web placed on the Fourdrinier wire is about 10 . . . 20%, commonly about 15%. The strength of such a wet web is very low, and it can be cut readily. In the cutting performed in the wet end of a paper and board machine, it is possible to use low pressures in the diagonal cutting. The pressure values are, as a rule, about 10 . . . 20 bar, more commonly about 12 . . . 14 bar.

At the end of the drying section, the dry solids content of the web is about 90 . . . 98%, most commonly about 94 . . . 95%. After the drying section of a coater, the dry solids content is commonly about 96 . . . 98%. The strength of such a web is far higher than the strength of a web whose dry solids content is about 20% or less, the latter sort of web being usually cut by means of a water jet.

The method has incontestable advantages over the methods that are used currently. It does not produce cutting dust in the air, which dust is detrimental when it adheres to the paper web and to the equipment in the paper mill. The devices in accordance with the method of the invention are simple and durable, and they require little maintenance. The cutting process does not increase the noise level in the premises to a significant extent. The web is not torn irregularly, nor is it broken because of the cutting, which is of great importance. In the cutting in accordance with the method, the web is not separated from the drying wire, which simplifies and improves the transfer of the web, which results in an improved efficiency in the time of utilization of the machine.

SUMMARY OF THE INVENTION

By means of the method in accordance with the invention, the leader can be cut, without risk of being torn, by means of a simple and inexpensive low-pressure water jet, whose pressure is of an order of 100 bar. The invention is characterized in that the web is cut against the drying wire by means of a pressurized water jet, whose pressure is 40 . . . 400 bar.

In the following, the invention will be described in detail with reference to some exemplifying embodiments of the invention illustrated in the figures in the accompanying drawing, the invention being not confined to the details of said embodiments.

DETAILED DESCRIPTION OF THE INVENTION

Figures 1A, 1B:
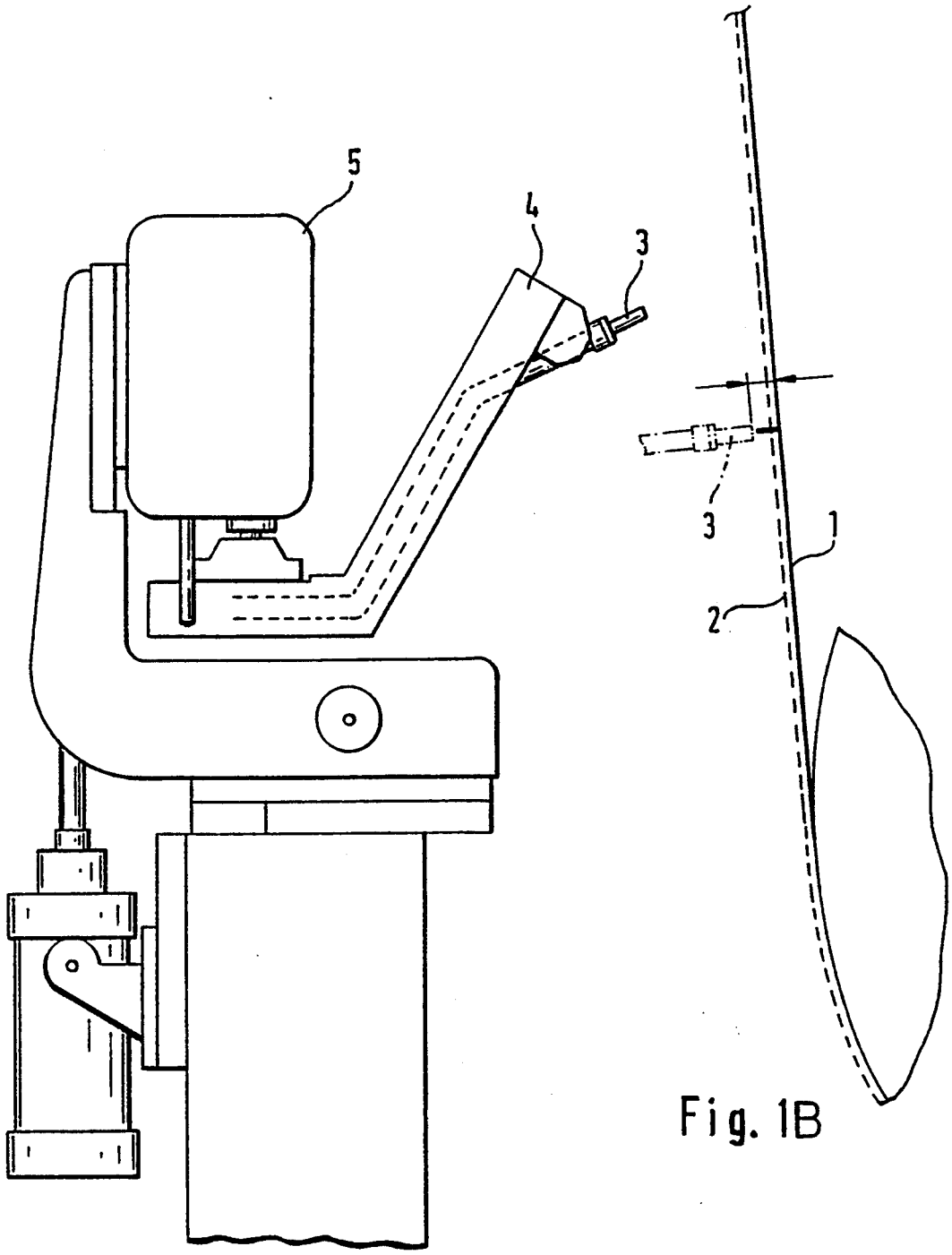
FIGS. 1A, 1B, 2, 3, 4, and 5 show a water-jet device in accordance with the method of the invention for cutting of the leader as viewed from the side of the paper machine.
Figure 2:
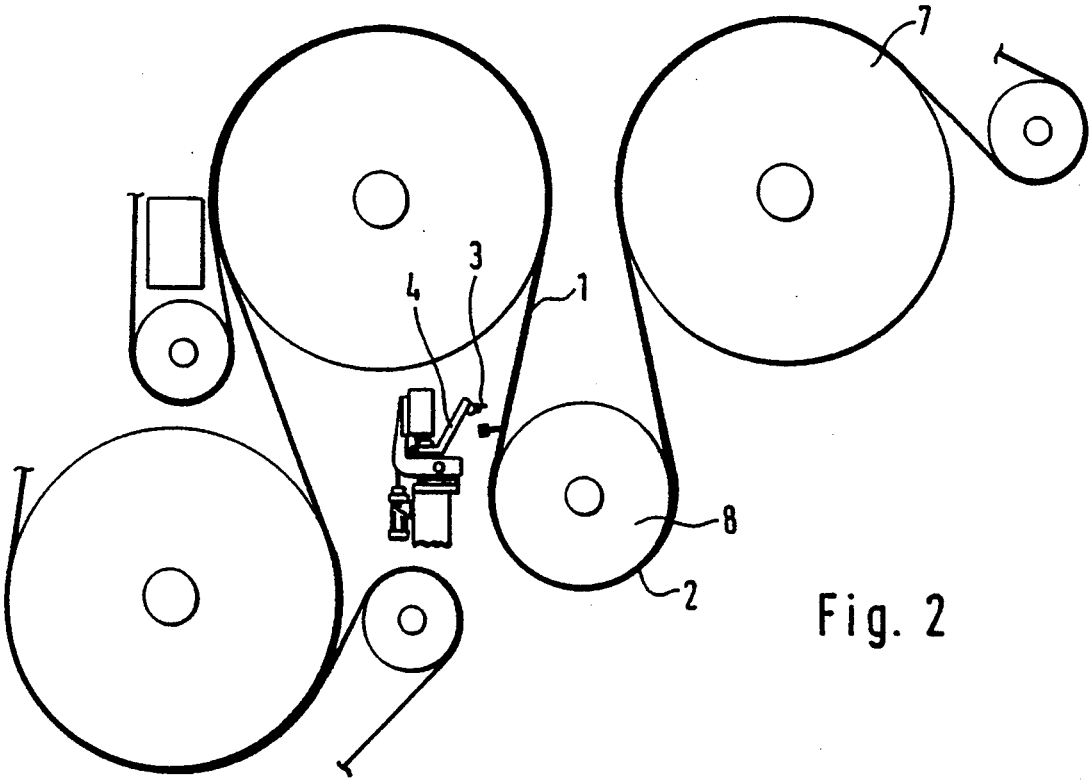

The drying wire is denoted with the numeral 1, the web to be cut with the numeral 2, the cutting nozzle with the numeral 3, the cutter transfer sledge with the numeral 4, and the cutter transfer beam with the numeral 5. The drying cylinders are denoted with the numeral 7, the perforated and/or grooved suction roll with the numeral 8. In FIG. 1A, the nozzle of the cutter device is illustrated when in the rest position of the mechanism, whereas in FIG. 1B, a separate nozzle illustrates its position when the nozzle arm 4 and the nozzle 3 are in the cutting position. The pressure-pump/motor assembly is usually placed at the operating side or at the driving side, from which the water is passed by means of a flexible hose into the nozzle, which moves along with the transfer sledge.

Figure 3:
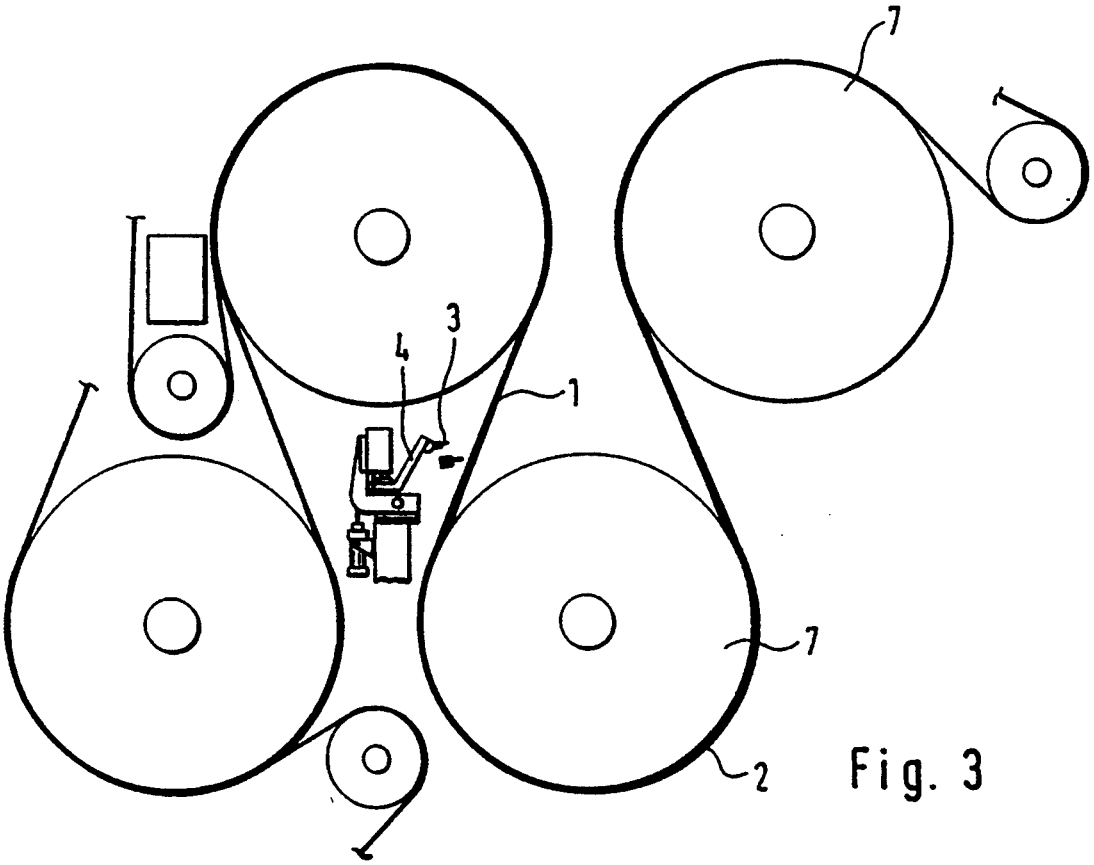
Figure 4:
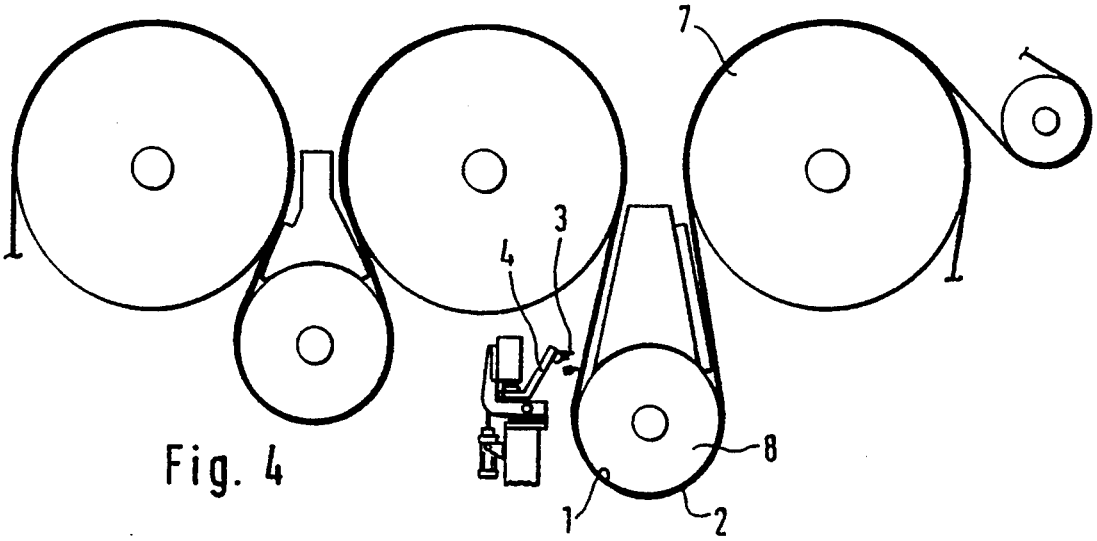
Figure 5:
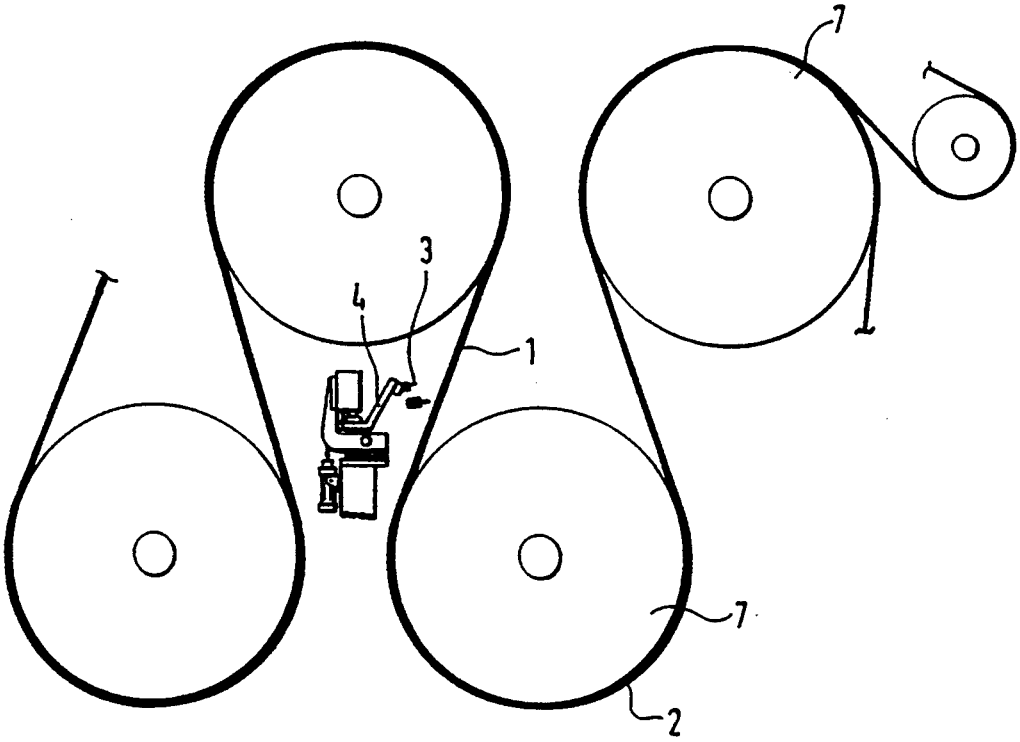

The cutting is carried out by spraying a water jet against the face of the paper web 2 which rests on the drying wire 1, which water jet cuts through the paper web 2 and passes through the drying wire I without damaging the wire, while, at the same time, carrying away any fibres separated from the web. The cutting nozzle 3 is guided in a way in itself known from other cutters across the web 2 with a suitable speed distribution so that the result is a web 2 leader and a widening portion of appropriate shape. By means of suitable arrangements, the leader can be cut both in the case of single-wire draw and in the case of twin-wire draw. The cutter can be mounted at a rising or failing side of the web 2. As shown in the FIGS. 2–5, the cutting nozzle 3 can be positioned so that it is movable in a pocket space defined between a pair of cylinders, e.g., drying cylinders as shown in FIGS. 3 and 5.

In the following, the patent claims will be given, and the various details of the invention may show variation within the scope of the inventive idea defined in said claims.

What is claimed is:

1. Method for cutting a leader of a web in a paper or board machine in a drying section of the machine, comprising the steps of:

arranging drying cylinders and suction rolls in the drying section, carrying the web on a drying wire in a single wire draw of the drying section between said drying cylinders and said suction rolls such that a face of the web is exposed, and applying a pressurized water jet to the exposed face of the web as the web is carried on the drying wire to thereby cut the web.

2. Method as claimed in claim 1, wherein the pressure of the pressurized water jet is from about 40 to about 400 bar.

3. The method of claim 2, wherein the pressure of the pressurized water jet is about 100 bar.

4. Method as claimed in claim 1, further comprising the steps of:

arranging said drying cylinders in the drying section to define pocket spaces therebetween, directing the pressurized water jet at the exposed face of the web through a cutting nozzle, and moving the cutting nozzle in the pocket spaces between the drying cylinders.

5. The method of claim 1, further comprising the step of providing the pressurized water jet with a sufficient pressure to cut the web and pass through the drying wire on which the web is being carried to carry away fibers separated from the web.

6. Method for cutting a leader of a web in a paper or board machine in a drying section of the machine, the drying section including suction rolls and drying cylinders arranged to define pocket spaces therebetween, comprising the steps of:

carrying the web on a drying wire in a single wire draw of the drying section between said drying cylinders and said suction rolls such that a face of the web is exposed, directing a pressurized water jet at the exposed face of the web through a cutting nozzle as the web is carried on the drying wire, and moving the cutting nozzle across the width of the web in the pocket spaces between the drying cylinders to thereby cut the web.

* * * * *